US009930756B2

(12) United States Patent
Roberts

(10) Patent No.: US 9,930,756 B2
(45) Date of Patent: Mar. 27, 2018

(54) APPARATUS, METHODS AND SYSTEMS FOR PROVIDING LIGHTING AND COMMUNICATION

(75) Inventor: John Roberts, Grand Rapids, MI (US)

(73) Assignee: CREE, INC., Durham, NC (US)

( * ) Notice: Subject to any disclaimer, the term of this patent is extended or adjusted under 35 U.S.C. 154(b) by 1172 days.

(21) Appl. No.: 12/056,431

(22) Filed: Mar. 27, 2008

(65) Prior Publication Data

US 2009/0241390 A1 Oct. 1, 2009

(51) Int. Cl.

| | |
|---|---|
| ***G09F 13/00*** | (2006.01) |
| ***H05B 37/02*** | (2006.01) |
| ***H05B 33/02*** | (2006.01) |
| ***G09F 13/22*** | (2006.01) |
| *G09F 13/04* | (2006.01) |

(52) U.S. Cl.

CPC ..... *H05B 37/0254* (2013.01); *G09F 13/22* (2013.01); *H05B 33/02* (2013.01); *G09F 2013/0459* (2013.01); *G09F 2013/222* (2013.01)

(58) Field of Classification Search

CPC ... H05B 37/0245; G09F 13/22; G09F 13/005; G09F 2013/0459; F21S 9/022; G08B 7/066

USPC ..... 340/815.45, 815.53, 815.66, 541, 573.1, 340/944, 905, 907; 362/249.02, 249.13, 362/800; 245/83, 82, 39, 84; 116/202

See application file for complete search history.

(56) References Cited

U.S. PATENT DOCUMENTS

| | | | | |
|---|---|---|---|---|
| 6,841,947 | B2 * | 1/2005 | Berg-johansen | 315/169.3 |
| 6,994,452 | B2 * | 2/2006 | Rozenberg et al. | 362/183 |
| 7,690,802 | B2 * | 4/2010 | Higley et al. | 362/20 |
| 2002/0008637 | A1 * | 1/2002 | Lemelson et al. | 340/907 |
| 2006/0170376 | A1 * | 8/2006 | Piepgras | E06B 3/6722 315/295 |
| 2008/0136334 | A1 * | 6/2008 | Robinson | H05B 37/0254 315/151 |
| 2008/0136661 | A1 * | 6/2008 | Pederson et al. | 340/815.45 |
| 2008/0236007 | A1 * | 10/2008 | Au et al. | 40/592 |

FOREIGN PATENT DOCUMENTS

| | | | | |
|---|---|---|---|---|
| JP | S 59-186092 A | | 10/1984 | |
| JP | H 03-222202 A | | 10/1991 | |
| JP | H 10-326382 A | | 12/1998 | |
| JP | 2006-003750 A | | 1/2006 | |
| JP | 2007-171702 A | | 7/2007 | |
| JP | 2007-248687 | * | 9/2007 | G09G 3/32 |
| JP | 2007-248687 A | | 9/2007 | |
| JP | 2008-152080 A | | 7/2008 | |
| JP | 2008-270212 A | | 11/2008 | |
| WO | WO 0216826 A1 | | 2/2002 | |

OTHER PUBLICATIONS

Japanese Office Action Corresponding to Japanese Patent Application No. 2009-074726; dated: Jul. 2, 2013; Foreign Text, 2 Pages, English Translation Thereof, 2 Pages.

* cited by examiner

*Primary Examiner* — Hongmin Fan

(74) *Attorney, Agent, or Firm* — Sage Patent Group

(57) ABSTRACT

Provided are apparatus, methods and systems for providing lighting and communication. An apparatus may include a solid-state lighting panel including multiple solid-state light emitters and an input module that is configured to receive an input signal from a lighting panel group controller that is configured to collaboratively control multiple solid-state lighting panels.

11 Claims, 8 Drawing Sheets

APPARATUS, METHODS AND SYSTEMS FOR PROVIDING LIGHTING AND COMMUNICATION

FIELD OF THE INVENTION

The present invention relates to lighting and, more particularly, to solid-state lighting panels.

BACKGROUND

Solid-state lighting panels may be used as solid-state backlight units for displays, as lighting panels for general illumination, as backlights for signage, and/or for other purposes. For example, solid-state backlighting units may be used for displays that may communicate information via graphics generated by, for example, an LCD screen in front of a two dimensional array of discrete light sources. General illumination lighting panels may be used to provide illumination but, absent an informational content component such as an LCD screen or other static template and/or filter, typically provide no additional functionality than illumination.

SUMMARY

Provided are apparatus, methods and systems for lighting and communication. In some embodiments, apparatus may include a solid-state lighting panel including multiple solid-state light emitters and a multi-mode lighting panel controller that is configured to control the solid-state light emitters in a first mode to illuminate an area and a second mode to communicate a message within the area.

In some embodiments, the multi-mode controller includes an input module that is configured to receive an input signal, wherein the multi-mode controller selects the first mode and/or the second mode responsive to the input signal. In some embodiments, the solid-state light emitters include multiple first color emitters corresponding to the first mode and multiple second color emitters corresponding to the second mode.

In some embodiments, at least a portion of the solid-state emitters include individually addressable multi-color solid-state light emitters that are configured to emit white light in the first mode and non-white light in the second mode and wherein the solid-state light emitters are selectively operated to display an image that conveys information.

In some embodiments, the message is communicated via a portion of the solid-state light emitters that collectively communicate the message via a symbol formed through an array selection. In some embodiments, the multi-mode controller is configured to selectively control the solid-state light emitters to display a text message. Some embodiments include means for emitting light in a dynamic configuration via a sequence corresponding to an input signal.

Methods according to some embodiments of the present invention may include illuminating an area by operating multiple first color solid-state light emitters and multiple second color solid-state light emitters in a solid-state lighting panel. Methods may further include communicating a message via the solid-state lighting panel by selectively operating the plurality of second color solid-state light emitters.

In some embodiments, communicating a message includes selectively operating the plurality of second color solid-state light emitters to form an image that is configured to convey information.

In some embodiments, the multiple first color solid-state light emitters include blue-emitting LEDs coated with a wavelength conversion phosphor. In some embodiments, the multiple second color solid-state light emitters include red-emitting LEDs. Some embodiments include selectively operating the plurality of second color solid-state light emitters, wherein the plurality of second color solid-state light emitters are individually addressable.

Some embodiments include receiving a communication mode signal, wherein the message is responsive to the communication mode signal. In some embodiments, the communication mode signal is received from a central system controller and the communication mode signal is selectively updated responsive to data received from remote environmental condition sensors.

Some embodiments of the present invention include systems for providing illumination and communication. Embodiments of such systems may include a multi-mode solid-state lighting panel configured to provide illumination in a first mode and to communicate information in a second mode responsive to a control signal and a central controller configured to a transmit the control signal to at least one multi-mode solid-state lighting panel.

Some embodiments include an environmental condition sensor configured to provide an environmental information signal to the central controller and/or the multi-mode solid-state lighting panel. In some embodiments, the central controller is further configured to, responsive to receipt of the environmental information signal, transmit an updated control signal to the at least one multi-mode solid-state lighting panel. In some embodiments, the at least one multi-mode solid-state lighting panel is further configured to communicate updated information responsive to the updated control signal.

In some embodiments, the at least one multi-mode solid-state lighting panel is further configured to communicate updated information responsive to the environmental information signal. In some embodiments, the multi-mode solid-state lighting panel includes multiple solid-state light emitters, wherein a first portion of the solid-state light emitters are operated in the first mode and wherein a second portion of the solid-state light emitters are operated in the second mode.

In some embodiments, the multi-mode solid-state lighting panel includes multiple multi-color individually-addressable solid-state light emitters, wherein the multi-color individually-addressable solid-state light emitters are selectively operated responsive to the control signal. In some embodiments, the multi-mode solid-state lighting panel is further configured to communicate information in the second mode via a dynamically presented plurality of images formed by selective operation of a plurality of solid-state light emitters.

Some embodiments of the present invention include an apparatus that includes a solid-state lighting panel. The solid-state lighting panel may include multiple solid-state light emitters and an input module that is configured to receive an input signal from alighting panel group controller. The lighting panel group controller may be configured to collaboratively control multiple solid-state lighting panels that are arranged above a personnel space in a spaced apart manner to disperse illumination throughout a substantial portion of the personnel space.

In some embodiments, the lighting panel group controller may be configured to collaboratively control the solid-state lighting panels in a first mode to illuminate an area and in a second mode to communicate information. In some embodiments, the solid-state light emitters in at least one of the plurality of solid-state lighting panels may include multiple first color emitters corresponding to the first mode and second color emitters corresponding to the second mode. In some embodiments, a first portion of the solid-state lighting panels are illuminated corresponding to the first mode and the second mode and a second portion of the solid-state lighting panels are illuminated corresponding to the first mode and not the second mode.

In some embodiments, the solid-state light emitters in the solid-state lighting panels include multiple first color emitters and second color emitters. The first color emitters may be illuminated in a first portion of the solid-state lighting panels in the first mode and the second mode and the second color emitters may be illuminated in a second portion of the solid-state lighting panels corresponding to the second mode. Some embodiments include means for selectively operating the solid-state lighting panels in a dynamic configuration via a sequence corresponding to the input signal.

Some embodiments of the present invention include methods that may include illuminating an area by operating multiple solid-state lighting panels that are arranged in a personnel space in a spaced apart manner in a first mode responsive to an input signal received from a lighting panel group controller. Such methods may include communicating information via the solid-state lighting panels by selectively operating a first portion of the solid-state lighting panels responsive to the input signal.

In some embodiments, communicating information via the solid-state lighting panels includes selectively operating a second portion of the solid-state lighting panels in a second mode responsive to the input signal. In some embodiments, ones of the second portion of the solid-state lighting panels include multi-color solid-state light emitters that are configure to emit substantially white light in the first mode and substantially non-white light in the second mode.

In some embodiments, the lighting panel group controller includes a building control system, while in some embodiments the lighting panel group controller generates the input signal responsive to a building control system signal. Some embodiments include generating the input signal responsive to data received from at least one environmental sensor.

Some embodiments of the present invention include a system for providing illumination and communication. Some embodiments of such systems may include multiple solid-state lighting panels that are arranged in a personnel space in a spaced apart manner and that include multiple solid-state light emitters and are configured to provide illumination in a first mode and to communicate information in a second mode, responsive to input signals received at the solid-state lighting panels. Some embodiments may include a lighting panel group controller that is configured to transmit the input signals to at least one of the solid-state lighting panels.

Some embodiments include an environmental condition sensor that is configured to provide an environmental information signal to the lighting panel group controller. In some embodiments, the solid-state lighting panels include a first portion of solid-state lighting panels that are configured to provide illumination in the first mode and the second mode and a second portion of solid-state lighting panels that are configured to provide illumination in the first mode and not in the second mode, wherein the collaborative operation of the first portion and the second portion in the second mode communicate information.

In some embodiments, the information includes an egress route and/or an emergency condition indication. In some embodiments, at least one of the solid-state lighting panels includes a first portion of the solid-state light emitters that are configured to emit substantially white light and a second portion of the solid-state light emitters that are configured to emit substantially non-white light. The first portion of the solid-state light emitters may be configured to emit light responsive to the first mode and the second portion of the solid-state light emitters may be configured to emit light during the second mode.

In some embodiments, the lighting panel group controller is further configured to generate the input signal responsive to an environmental information signal that is generated by an environmental condition sensor. In some embodiments, the lighting panel group controller includes a building control system. In some embodiments, the lighting panel group controller is further configured to dynamically communicate information in the second mode by transmitting a sequence of the input signals to the solid-state lighting panels.

BRIEF DESCRIPTION OF THE DRAWINGS

The accompanying drawings, which are included to provide a further understanding of the invention and are incorporated in and constitute a part of this application, illustrate certain embodiment(s) of the invention.

DETAILED DESCRIPTION OF EMBODIMENTS OF THE INVENTION

Figure 1A:
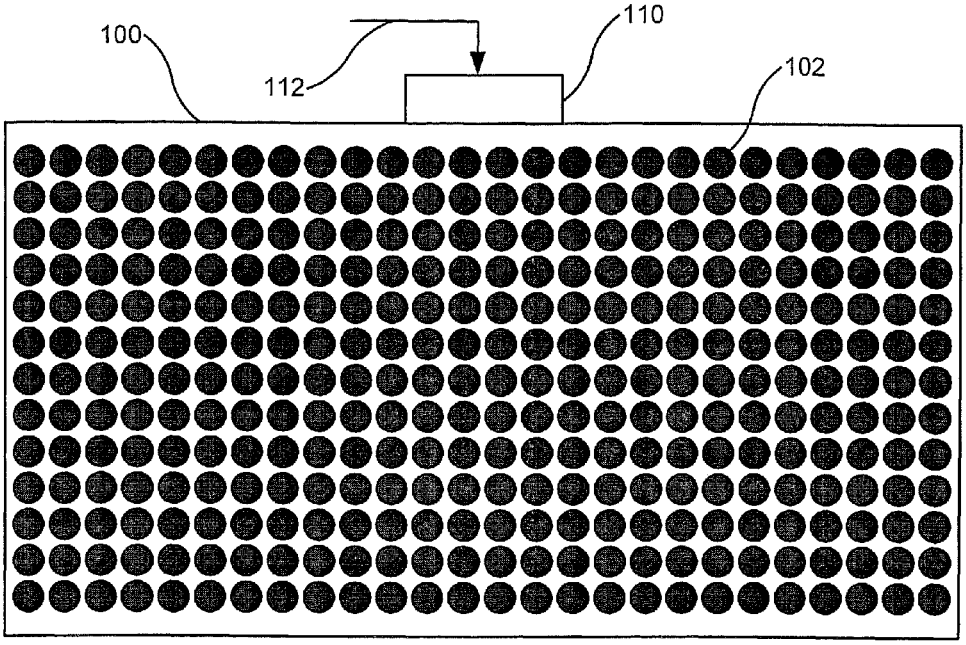
FIGS. 1A-1D are a front views illustrating different modes of an apparatus for providing general illumination and communication according to some embodiments of the present invention.

Embodiments of the present invention now will be described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure will be thorough and complete, and will fully convey the scope of the invention to those skilled in the art. Like numbers refer to like elements throughout.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of the present invention. As used herein, the term "and/or" includes any and all combinations of one or more of the associated listed items.

It will be understood that when an element such as a layer, region or substrate is referred to as being "on" or extending "onto" another element, it can be directly on or extend directly onto the other element or intervening elements may also be present. In contrast, when an element is referred to as being "directly on" or extending "directly onto" another element, there are no intervening elements present. It will also be understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present.

Relative terms such as "below" or "above" or "upper" or "lower" or "horizontal" or "vertical" may be used herein to describe a relationship of one element, layer or region to another element, layer or region as illustrated in the figures. It will be understood that these terms are intended to encompass different orientations of the device in addition to the orientation depicted in the figures.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" "comprising," "includes" and/or "including" when used herein, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms used herein should be interpreted as having a meaning that is consistent with their meaning in the context of this specification and the relevant art and will not be interpreted in an idealized or overly formal sense unless expressly so defined herein.

The present invention is described below with reference to flowchart illustrations and/or block diagrams of methods, systems and computer program products according to embodiments of the invention. It will be understood that some blocks of the flowchart illustrations and/or block diagrams, and combinations of some blocks in the flowchart illustrations and/or block diagrams, can be implemented by computer program instructions. These computer program instructions may be stored or implemented in a microcontroller, microprocessor, digital signal processor (DSP), field programmable gate array (FPGA), a state machine, programmable logic controller (PLC) or other processing circuit, general purpose computer, special purpose computer, or other programmable data processing apparatus such as to produce a machine, such that the instructions, which execute via the processor of the computer or other programmable data processing apparatus, create means for implementing the functions/acts specified in the flowchart and/or block diagram block or blocks.

These computer program instructions may also be stored in a computer readable memory that can direct a computer or other programmable data processing apparatus to function in a particular manner, such that the instructions stored in the computer readable memory produce an article of manufacture including instruction means which implement the function/act specified in the flowchart and/or block diagram block or blocks.

The computer program instructions may also be loaded onto a computer or other programmable data processing apparatus to cause a series of operational steps to be performed on the computer or other programmable apparatus to produce a computer implemented process such that the instructions which execute on the computer or other programmable apparatus provide steps for implementing the functions/acts specified in the flowchart and/or block diagram block or blocks. It is to be understood that the functions/acts noted in the blocks may occur out of the order noted in the operational illustrations. For example, two blocks shown in succession may in fact be executed substantially concurrently or the blocks may sometimes be executed in the reverse order, depending upon the functionality/acts involved. Although some of the diagrams include arrows on communication paths to show a primary direction of communication, it is to be understood that communication may occur in the opposite direction to the depicted arrows.

Figure 1B:
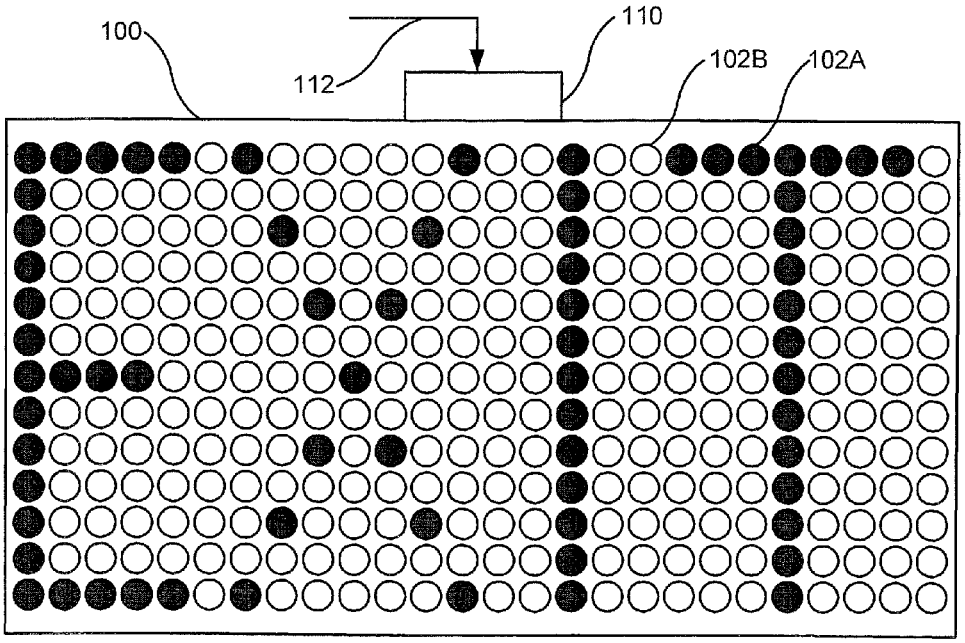

Reference is now made to FIGS. 1A-1D, which are front views illustrating different modes of an apparatus for providing general illumination and communication according to some embodiments of the present invention. For example, referring to FIG. 1A, a solid-state lighting panel 100 may include multiple solid-state light emitters 102. As illustrated in FIG. 1B, the solid-state light emitters 102 may be selectively addressed and/or controlled to provide one or more energized solid-state light emitters 102A and one or more de-energized solid-state light emitters 102B.

In some embodiments, the solid-state light emitters 102 may all be configured to emit light at substantially the same dominant wavelength. For example, the solid-state light emitters may be white LED lamps that include a blue-emitting LED coated with a wavelength conversion phosphor that converts some of the blue light emitted by the LED into yellow light. The resulting light, which is a combination of blue light and yellow light, may appear white to an observer. For example, a solid-state lighting panel 100 in an illuminating mode to be configured such that all of the solid-state light emitters 102 are energized solid-state lighting emitters 102A to provide general illumination of the proximate area. In some embodiments, variable levels of lighting may be provided by selectively the energizing a portion of the multiple solid-state light emitters 102 and/or by operating the solid-state light emitters 102 at a reduced current level.

Figure 1C:
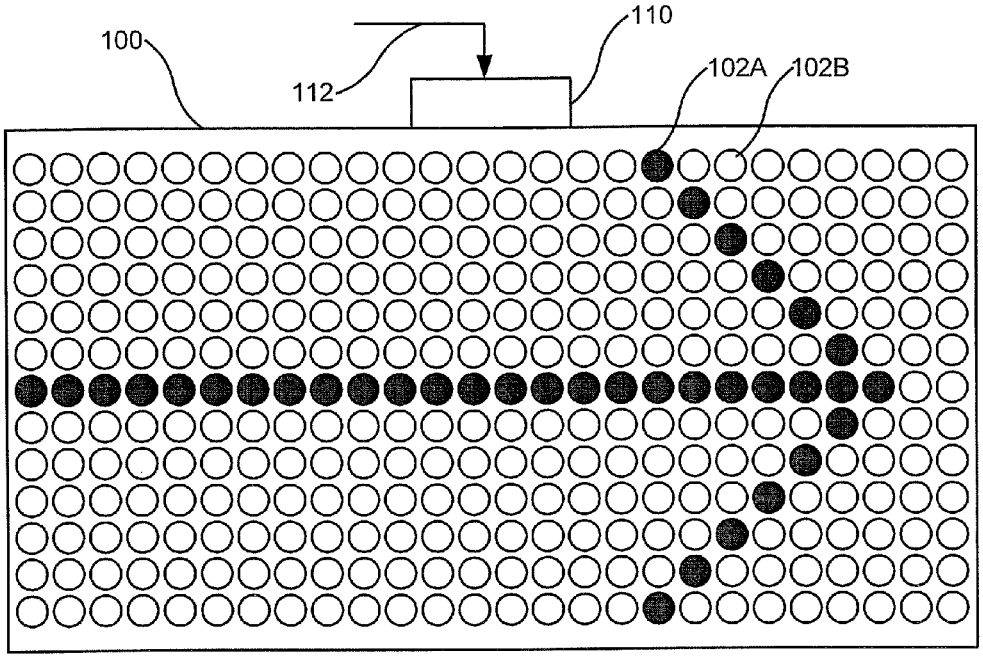

In some embodiments, information may be communicated by selectively operating a portion of the solid-state light emitters 102. For example, as illustrated in FIG. 1B, the solid-state lighting panel 100 may use a communication mode to identify an exit by selectively operating a portion of the solid-state emitters 102 that spell "EXIT". Similarly, as illustrated in FIG. 1C, a suggested route may be identified by selectively operating a portion of the solid-state emitters 102 to form an image of an arrow.

Figure 1D:
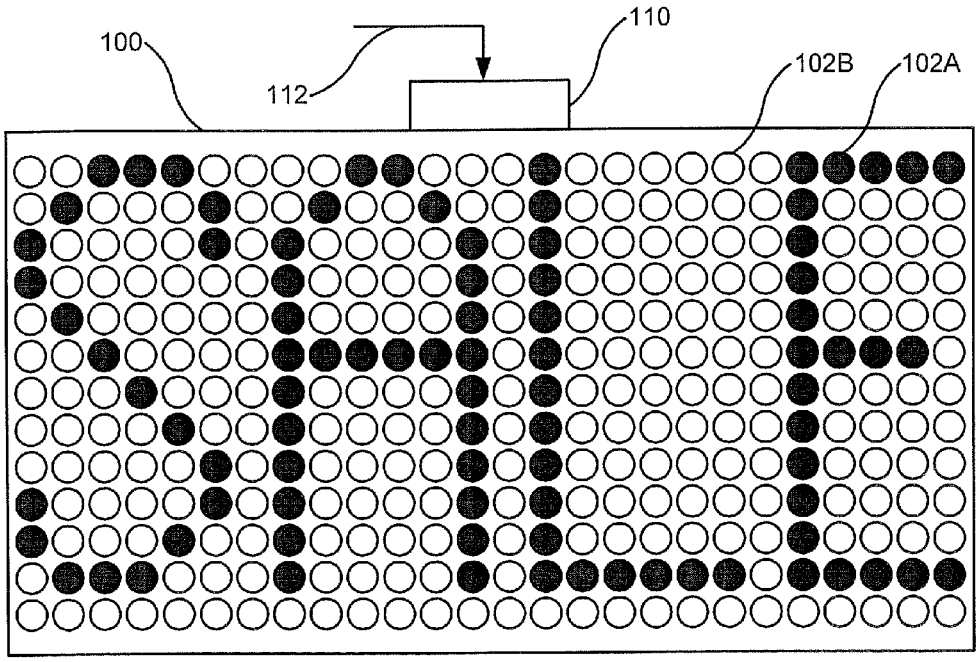

A solid-state lighting panel 100 may also be used in, for example, a commercial setting to identify a special event and/or activity. For example, as illustrated in FIG. 1D, a commercial event may be identified by selectively operating a portion of the solid-state emitters 102 to spell a word such as "SALE", among others. Other, non-illustrated, examples may include a solid-state lighting panel 100 used in a corporate, industrial, institutional, transportation and/or educational environment to indicate event start and stop times and/or status, among others. For example, class start and stop times and/or status may be displayed in an educational environment. Similarly, warnings and/or other information may be communicated on a mass transportation vehicle, such as, for example a bus and/or airplane.

In some embodiments, the solid-state light emitters 102 may include a first portion of solid-state light emitters 102 configured to emit light at a first dominant wavelength and a second portion of the solid-state light emitters 102 configured to emit light at a second dominant wavelength. In this manner, the first portion of solid-state light emitters may be operated to provide general illumination and the second portion may be operated to communicate information. For example, the first portion of the solid-state light emitters 102 may be configured to emit substantially white light to provide general illumination and the second portion of the solid-state light emitters 102 may be configured to emit substantially red light to indicate a condition such as, for example, fire, earthquake, weather condition, and/or other unsafe conditions and/or events, among others. Additionally, the second portion of the solid-state light emitters 102 may be selectively operated to communicate additional information via an image.

In some embodiments, the solid-state light emitters 102 may be configured as individually addressable multi-color emitters that may deliver substantially white light under normal operation for general illumination. In a communication mode, the multi-color emitters may be controlled to emit red light, among others. In this manner, in addition to providing text and image based communications, color coded communications may also be provided.

In addition to static text, images and/or colors, the solid-state light emitters 102 may be dynamically controlled corresponding to, for example, an image sequence to create the visual effect of motion. In some embodiments, the solid-state lighting panel 100 may be operated in a hybrid mode wherein a first portion of the solid-state light emitters 102 are operated to provide illumination and a second portion of the solid-state light emitters 102 are operated to communicate information.

The solid-state lighting panel 100 may also include a multi-mode lighting panel controller 110 that is configured to control the multiple solid-state light emitters 102. The multi-mode lighting panel controller 110 may be configured to receive an input signal 112. The multi-mode lighting panel controller 110 may select an illumination and/or communication mode responsive to the input signal 112. The input signal 112 may be received from, for example, an external system that may transmit the input signal 112 responsive to an alarm, emergency, scheduled event, manual input, and/or environmental sensor, among others.

Figure 2:
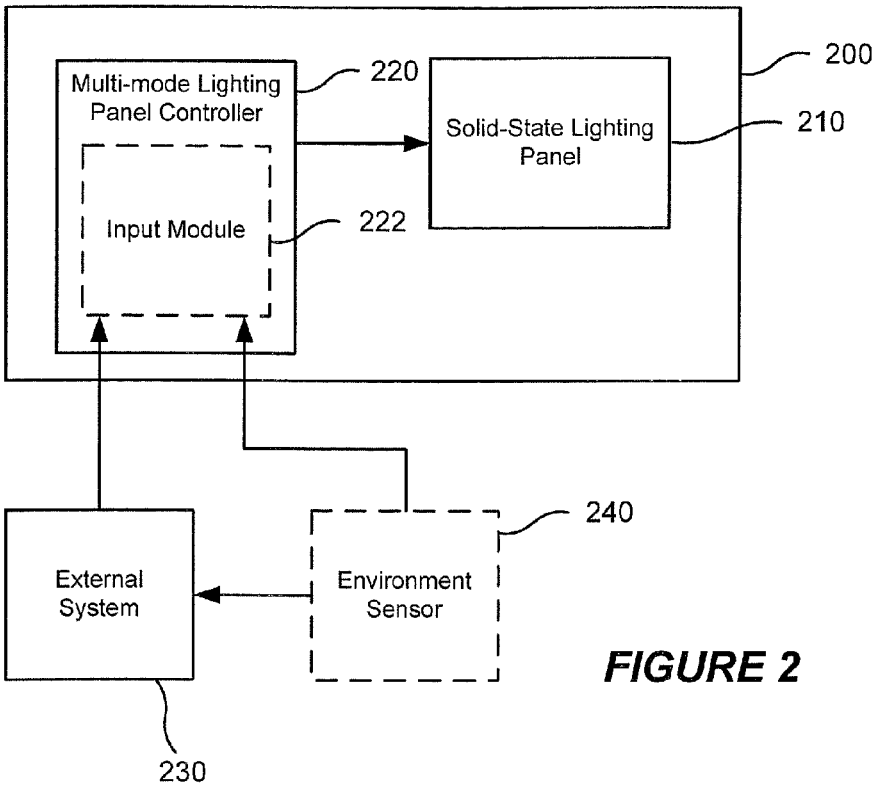
FIG. 2 is a block diagram illustrating an apparatus according to some embodiments of the present invention.

Reference is now made to FIG. 2, which is a block diagram illustrating an apparatus according to some embodiments of the present invention. A multi-mode illumination apparatus 200 includes a solid-state lighting panel 210. The solid-state lighting panel may include multiple solid-state light emitters that may be controlled by a multi-mode lighting panel controller 220. The multi-mode lighting panel controller 220 may be configured to control the solid-state light emitters in a first mode to illuminate an area and in a second mode to communicate a message within the area. In some embodiments, the solid-state light emitters may include multiple first color emitters corresponding to the first mode and multiple second color emitters corresponding to the second mode.

In some embodiments, at least a portion of the solid-state light emitters may include individually addressable multi-color solid-state light emitters that may be configured to emit substantially white light in the first mode and substantially non-white light in a second mode. In some embodiments, the solid-state light emitters may be operated to provide illumination in the first mode. In some embodiments, the solid-state light emitters may be selectively operated to display an image that conveys information in the second mode. For example, the image may include text and/or a symbol that may be formed through an array selection of specific solid-state light emitters.

In some embodiments, the multi-mode lighting panel controller 220 may include an input module 222 that is configured to receive an input signal. The multi-mode lighting panel controller 220 may be configured to select the first mode and/or the second mode responsive to the input signal. In some embodiments, an input signal may be generated by an external system 230. For example, an external system 230 may be event, alarm, and/or schedule based.

In some embodiments, the input module 222 may be configured to receive an input signal from an environment sensor 240. For example, an environment sensor 240 may be used to sense temperature and/or smoke in the case of alarm and/or emergency. In such circumstances, the multi-mode lighting panel controller 220 may be configured to provide an alternative communication, such as information corresponding to an alternate exit route. In some embodiments, the environment sensor 240 may be a personnel sensor that may be used to trigger a specific communication corresponding to the presence of personnel. For example, in a commercial context, when a customer in a store enters a specific area, a communication regarding a commercial event such as, for example, a sale, special and/or discount may be provided. In addition to providing a signal to the input module 222, an environment sensor 240 may also provide a signal to the external system 230, which may then send an input signal to the multi-mode lighting panel controller 220.

Figure 3:
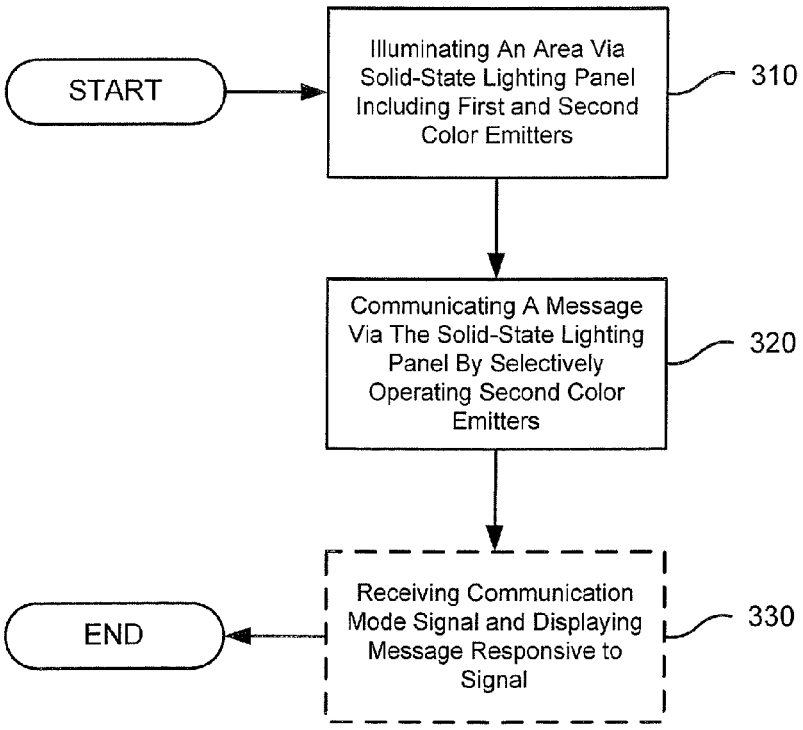
FIG. 3 is a block diagram illustrating operations according to some embodiments of the present invention.

Reference is now made to FIG. 3, which is a block diagram illustrating operations according to some embodiments of the present invention. Operations include illuminating an area via a solid-state lighting panel that includes first and second color solid-state light emitters (block 310). In some embodiments, illuminating may be performed by operating all of the first and second color solid-state light emitters.

In some embodiments, the first color solid-state light emitters may emit a substantially white light output. For example, some embodiments may provide that the first color solid-state light emitters are blue-emitting LEDs coated with a wavelength conversion phosphor that converts a portion of the emitted light to yellow light. Some embodiments may provide that the first color solid-state light emitters include multi-color emitters that may each be controlled to deliver white light in an illuminating mode.

In some embodiments, the second color solid-state light emitters may emit a substantially non-white light output. For example, red-emitting LEDs may be used in combination with the first color solid-state light emitters to increase a red light energy of the total light output.

Operations may also include communicating a message via the solid-state lighting panel by selectively operating the second color solid-state light emitters (block 320). In some embodiments, a portion of the second color solid-state light emitters may be designated to communicate one or more messages using images that may include text and/or symbols. For example, a portion of the second color solid-state light emitters may be selected to display the text "EXIT" and/or an arrow symbol to communicate exit and/or egress information.

In some embodiments, the second color solid-state light emitters may each be individually addressable and selectively operated to communicate the message via text, image, and/or color. For example, the second color solid-state emitters may be all operated to emit light at a dominant wavelength corresponding to a red color in the case of, for example, a fire and/or other emergency condition. In some embodiments, the message may be communicated using color coding. For example, a red color output may be known to indicate emergency, such as, for example, fire.

Operations according to some embodiments may include receiving a communication mode signal and displaying a message responsive to the signal (block 330). For example, some embodiments may be configured to receive an alarm signal corresponding to an emergency condition and communicate a message corresponding to an exit route and/or status. In some embodiments, communication mode signal may be used in a commercial context to provide information to potential customers and/or to draw attention to specific features in the commercial environment. By providing general lighting and the capacity for a variety of communications within the same apparatus, separate fixtures for the otherwise independent functions may be avoided.

Figure 4:
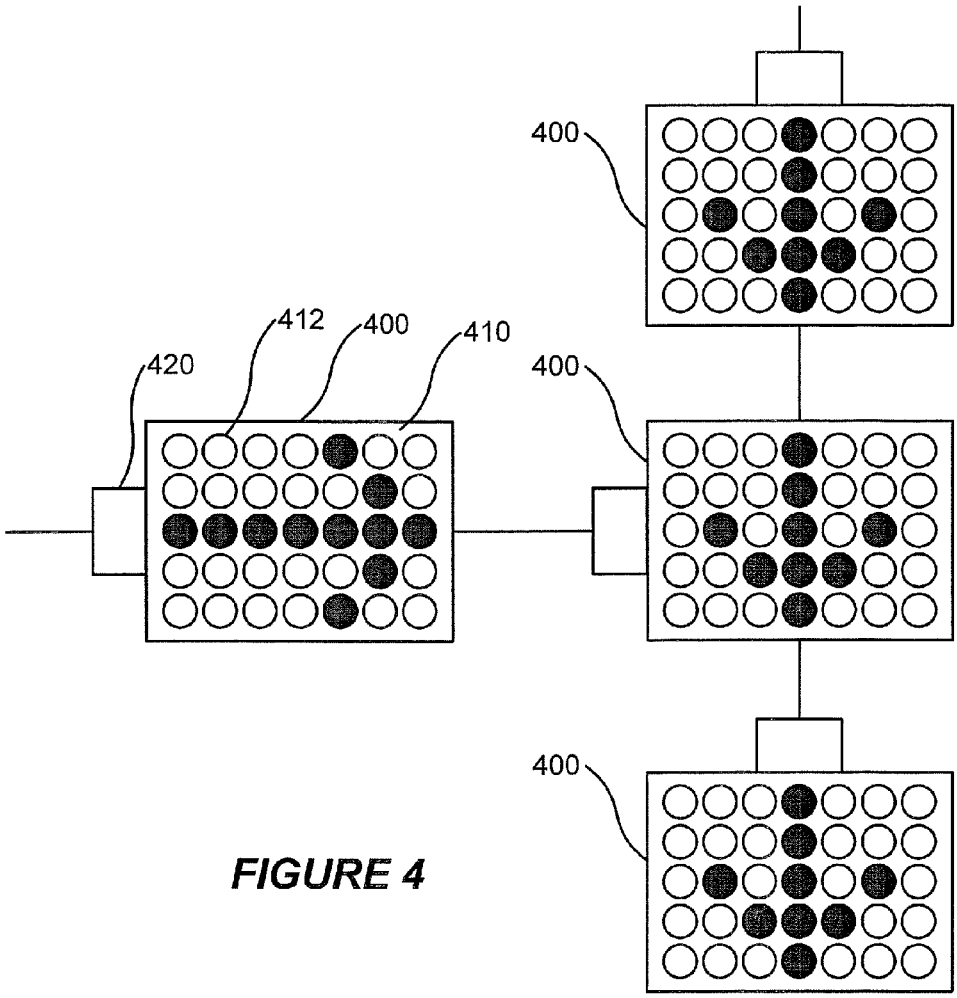
FIG. 4 is a block diagram illustrating multiple multi-mode apparatus in accordance with some embodiments of the invention.

Reference is now made to FIG. 4, which is a block diagram illustrating multiple multi-mode apparatus in a communication mode in accordance with some embodiments of the invention. Each of the multi-mode apparatus 400 may include a solid-state lighting panel 410 that includes multiple solid-state light emitters 412. In the communication mode, the solid-state light emitters 412 may be selectively operated to communicate one or more messages using symbols and/or text.

The solid-state light emitters 412 may be selectively operated via a multi-mode lighting panel controller 420. In some embodiments, the multi-mode lighting panel controller 420 may be configured to selectively operate the solid-state emitters 412 responsive to a received input signal. In some embodiments, multiple multi-mode apparatus 400 may be used in combination with one another to provide coordinated communication. For example, each solid-state lighting panel 410 may communicate a different message corresponding to different locations along an exit and/or egress route.

In some embodiments, the multi-mode lighting panel controller 420 may be configured to receive an input signal from a central controller and/or an external system and/or device and display a message responsive to the received input signal. In some embodiments, the multi-mode lighting panel controller 420 may be configured to receive data from a remote environmental condition sensor and communicate a message responsive to the received data. In some embodiments, the multi-mode lighting panel controller 420 of each of the multi-mode apparatus 400 may provide distributed control of the solid-state light emitters 412 and may function in the absence of a central controller.

Figure 5:
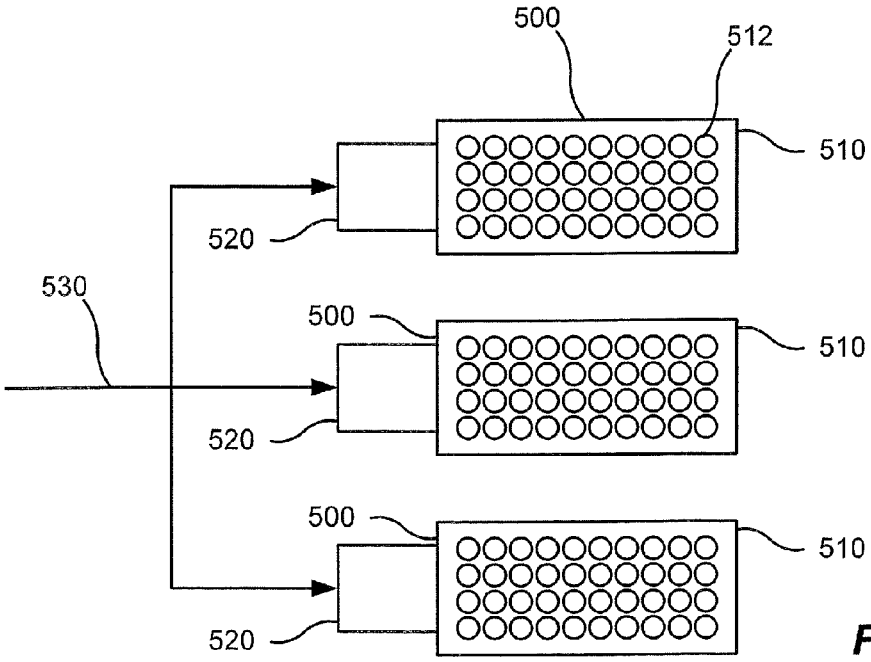
FIG. 5 is a block diagram illustrating multiple multi-mode apparatus in accordance with further embodiments of the invention.

Reference is now made to FIG. 5, which is a block diagram illustrating multiple multi-mode apparatus in accordance with further embodiments of the invention. Each of the multi-mode apparatus 500 may include a solid-state lighting panel 510 that includes multiple solid-state light emitters 512. In an illumination mode, the solid-state light emitters 512 may be operated to provide general illumination to an area proximate the multi-mode apparatus 500. For example, a maximum illumination may be provided by driving all of the solid-state light emitters 512 at a maximum current and/or duty cycle. A dimming function may be provided by driving a portion of the solid-state light emitters 512 and/or by driving the solid-state light emitters 512 at a current and/or duty cycle that is less than the maximum.

In the communication mode, the solid-state light emitters 512 may be selectively operated to communicate one or more messages using symbols and/or text. Each of the multi-mode apparatus 500 may include a multi-mode lighting panel controller 520 configured to selectively operate the solid-state light emitters 512. In some embodiments, the multi-mode lighting panel controller 520 may include an input module configured to receive an input signal 530. In some embodiments, the input signal 530 may be a signal common to all of the multi-mode apparatus 500. In some embodiments, the input signal 530 may selectively address each of the multi-mode apparatus 500 independently. In some embodiments, the multi-mode lighting panel controller 520 may include drivers configured to selectively provide current to the solid-state light emitters 512 and receive control data from a central controller.

Figure 6:
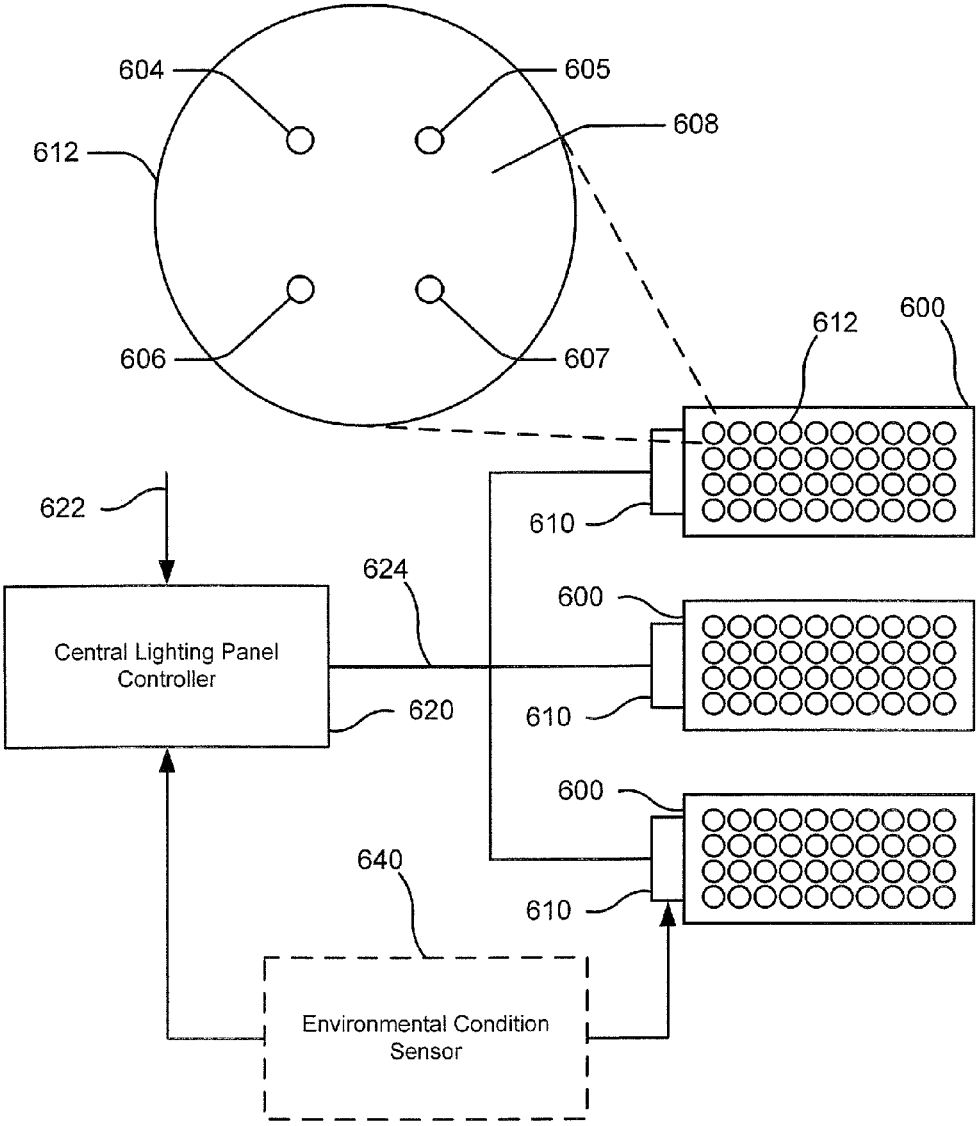
FIG. 6 is a block diagram illustrating multiple multi-color, multi-mode apparatus in accordance with some embodiments of the invention.

Reference is now made to FIG. 6, which is a block diagram illustrating multiple, multi-color multi-mode solid-state lighting panels in accordance with some embodiments of the invention. The multi-color multi-mode solid-state lighting panels 600 may be driven by respective multi-mode lighting panel controllers 610 to provide general illumination in a first mode and to communicate one or more messages in a second mode.

Each of the multi-color multi-mode solid-state lighting panels 600 may include multi-color solid-state light emitters 612. The multi-color solid-state light emitters 612 may be configured to emit substantially white light in a first mode and non-white light in the second mode. In the second mode, the multi-color solid-state light emitters 612 may be selectively operated to display an image that conveys information. For example, the image may include text and/or one or more symbols that conveys information. In some embodiments, a sequence of multiple images may be used to generate a light emitting dynamic configuration.

The multi-color solid-state light emitters 612 may include a substrate 608 on which individual colored LED chips 604-607 may be mounted. For example, a substantially red LED 604, a substantially blue LED 607, and two substantially green LEDs 605, 606 may be mounted on the substrate 608. Each of the individual colored LED chips 604-607 may be individually addressable. By selectively operating the LED chips 604-607, the color of the emitted light may be controlled. For example, all of the LED chips 604-607 may be driven to produce a substantially white light.

The multi-mode lighting panel controller 610 may be configured to receive input signals 624 from a central lighting panel controller 620. In this manner, multiple lighting panels used in a coordinated manner. In some embodiments, an environmental condition sensor 640 may be used to provide an environmental information signal to the central lighting panel controller 620 and/or the multi-mode lighting panel controllers 610. For example, in a commercial context, an environmental condition sensor 640 may be used to detect proximity of potential customers, who may subsequently be exposed to a message via one or more of the lighting panels.

Figure 7:
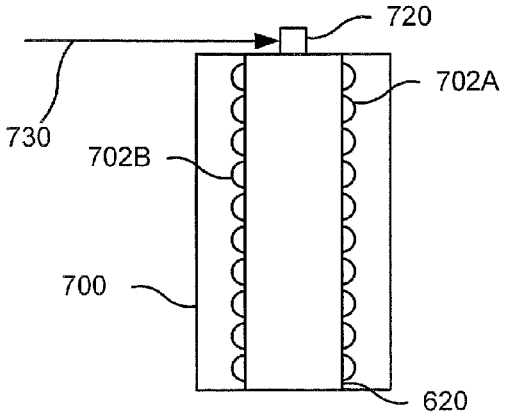
FIG. 7 is a side cross-sectional view of a multi-mode lighting apparatus in accordance with some embodiments of the invention.

Reference is now made to FIG. 7, which is a side cross-sectional side view of a two-sided multi-mode lighting apparatus in accordance with some embodiments of the invention. A multi-mode lighting apparatus 700 includes a two-sided solid-state lighting panel 710 that includes multiple solid-state light emitters 702. In some embodiments, the two-sided solid-state lighting panel 710 includes a first portion of the solid-state light emitters 702A positioned to emit light in a first direction and a second portion of the solid-state light emitters 702B positioned to emit light in a second direction that is different from the first direction.

The multi-mode lighting apparatus 700 further includes a multi-mode lighting panel controller 720 that is configured to control the solid-state light emitters 702A, 702B. In some embodiments, the multi-mode lighting panel controller 720 may be configured to receive an input signal 730 from a central controller, an external system and/or device, and/or an environment sensor, among others. In some embodiments, the multi-mode lighting apparatus 700 is configured to operate in one or more modes responsive to the input signal 730 received at the multi-mode lighting panel controller 720. For example, the multi-mode lighting apparatus 700 may selectively operate in an illumination mode and/or a communication mode responsive to the input signal 730.

Some embodiments may provide that a first portion of the solid-state light emitters 702A include blue-emitting LEDs coated with a wavelength conversion phosphor and/or LEDs that are configured to emit light having one or more dominant wavelengths. In some embodiments, the second portion of the solid-state light emitters 702B may include multicolor red, green, blue emitters that are configured to emit light across a broad spectrum. In some embodiments, the first portion of the solid-state light emitters 702A may operate in an illumination mode while the second portion of the solid-state light emitters 702B may operate in a communication mode. In some embodiments, the first portion of the solid-state light emitters 702A and the second portion of the solid-state light emitters 702B may both operate in either an illumination mode and/or a communication mode.

Figure 8A:
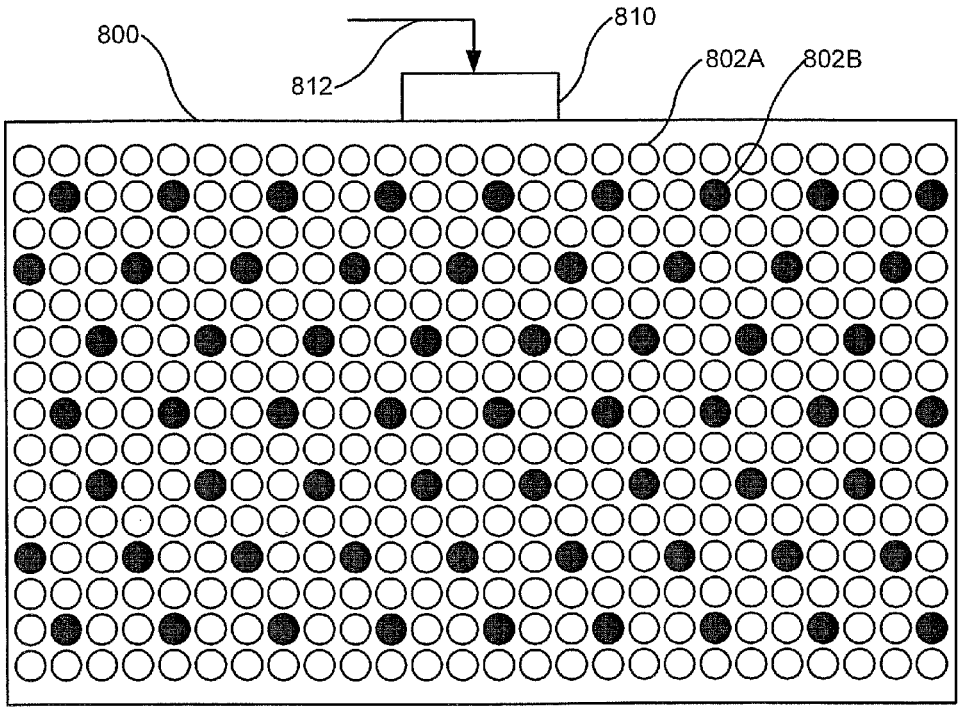
FIGS. 8A and 8B are front views illustrating different modes of an apparatus for providing general illumination and communication according to some embodiments of the present invention.
Figure 8B:
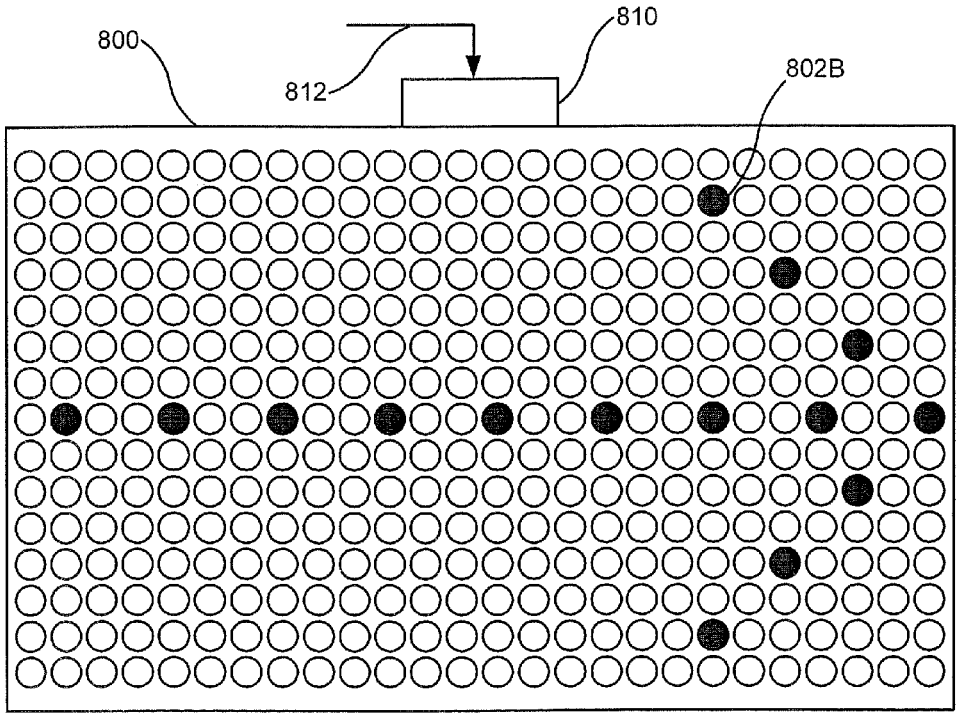

Reference is now made to FIGS. 8A and 8B, which are front views illustrating different modes of an apparatus for providing general illumination and communication according to some embodiments of the present invention. For example, referring to FIG. 8A, a solid-state lighting panel 800 may include multiple first color solid-state light emitters 802A and multiple second color solid-state light emitters 802B.

In some embodiments, the multiple first color solid-state light emitters 802A may include blue-emitting LEDs coated with a wavelength conversion phosphor. The resulting light, which is a combination of blue light and yellow light, may appear white to an observer. However, while light generated by such an arrangement may appear white, objects illuminated by such light may not appear to have a natural coloring, because of the limited spectrum of the light. For example, because the light may have little energy in the red portion of the visible spectrum, red colors in an object may not be illuminated well by such light. As a result, the object may appear to have an unnatural coloring when viewed under such a light source.

In some embodiments, the multiple second color solid-state light emitters 802B may include red-emitting LEDs. In this manner, the illumination provided by the combination of the first color solid-state light emitters 802A and the second color solid-state light emitters 802B may include an increased spectral warmth associated with more energy in the red portion of the visible spectrum.

As illustrated in FIG. 8B, a portion of the second color solid-state light emitters 802B may be selectively operated to form an image that is configured to convey information. In some embodiments, the second color solid-state light emitters 802B may be used to communicate a message via color coding and/or an image. For example, operating only red-emitting LEDs may be indicative of an emergency condition such as a fire, among others. In this manner, by selectively operating the first and second color solid-state light emitters 802A and 802B, spectrally rich light may be provided in an illumination mode and information may be conveyed and/or communicated in a communication mode.

In some embodiments, variable levels of lighting may be provided by selectively energizing portions of the first and/or second color solid-state light emitters 802A and 802B and/or by operating the first and/or second color solid-state light emitters 802A and 802B at reduced current levels.

Figure 9:
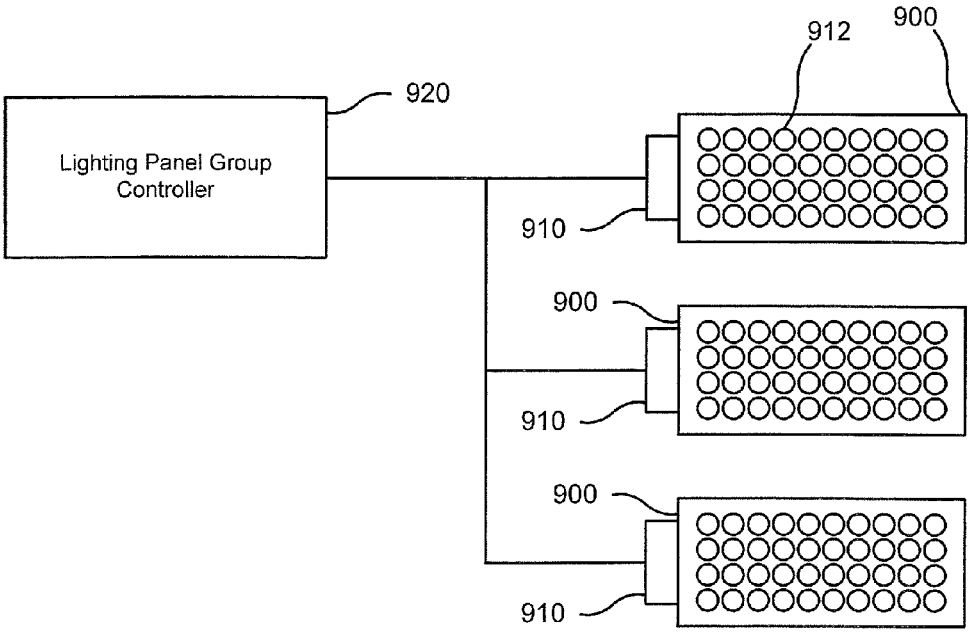
FIG. 9 is a block diagram illustrating a multimode apparatus that may be collaboratively operated with similar devices according to some embodiments of the present invention.

Reference is now made to FIG. 9, which is a block diagram illustrating a multimode apparatus that may be collaboratively operated with similar devices according to some embodiments of the present invention. The apparatus may include a solid-state lighting panel 900 that may include multiple solid-state emitters 912 and an input module 910. The input module 910 may be configured to receive an input signal from a lighting panel group controller 920. The lighting panel group controller 920 may be configured to collaboratively control multiple solid-state lighting panels 900.

The lighting panel group controller 920 may be configured to collaboratively control the multiple solid-state lighting panels 900 in a first mode to provide illumination and in a second mode to communicate information. In some embodiments, at least one of the solid-state lighting panels 900 may include multiple first color emitters that correspond to the first mode and multiple second color emitters that correspond to the second mode. For example, first color emitters may be configured to emit substantially white light for illumination and second color emitters may be configured to emit light having a dominant wavelength corresponding to the color red. In this manner, in the first mode all solid-state lighting panels 900 may be operated using the first color emitters.

In the second mode, solid-state lighting panels 900 that correspond to an emergency egress route may be operated using the first color emitters and other, non-route, solid-state lighting panels 900 may be operated using the second color emitters. Some embodiments may provide that the solid-state lighting panels 900 are selectively operated in the second mode. For example, solid-state lighting panels 900 that correspond to a route and/or a destination may be operated while other non-route and/or non-destination solid-state lighting panels 900 may be de-energized.

In some embodiments, lighting panel group controller 920 may be configured to collaboratively control the multiple solid-state lighting panels 900 in a dynamic manner corresponding to the second mode. For example, solid-state lighting panels 900 that correspond to a route and/or destination may be sequentially operated in a directional manner to indicate the direction of an egress route.

Figure 10:
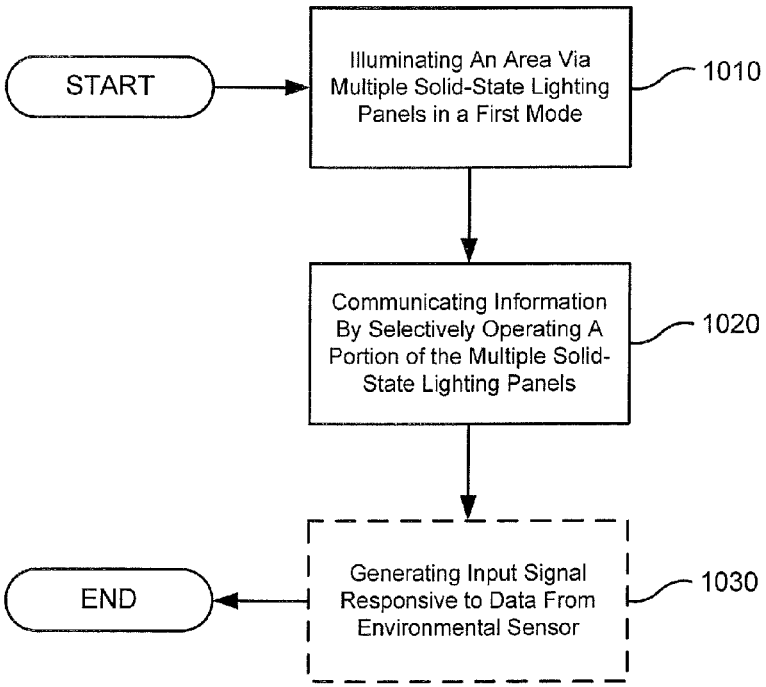
FIG. 10 is a block diagram illustrating operations according to some embodiments of the present invention.

Reference is now made to FIG. 10, which is a block diagram illustrating operations according to some embodiments of the present invention. An area may be illuminated using multiple solid-state lighting panels in a first mode responsive to an input signal received from a lighting panel group controller (block 1010). Information may be communicated by selectively operating a portion of the multiple solid-state lighting panels in a second mode (block 1020). In some embodiments, the multiple solid-state lighting panels may be selectively operated to indicate a desired route and/or destination. For example, in an emergency condition, selective ones of the solid-state lighting panels may be operated to illuminate and thus identify an egress route. In some embodiments, the selective operation to the solid-state lighting panels may include a dynamic operation that may indicate a direction of egress as well as a route. Some embodiments may provide that the solid-state lighting panels may include multi-color light emitters that may be selectively operated to supplement and/or enhance the lighting and/or communication operations. For example, the multi-color light emitters may be operated to emit substantially white light in the first mode and substantially non-white light in the second mode. In some embodiments, a destination, such as, for example, an exit door, may be distinctively identified using color and/or a dynamic and/or static operation relative to other of the solid-state lighting panels.

In some embodiments, communicating the information may correspond to a second mode that is responsive to the input signal received by the solid-state lighting panels from the lighting panel group controller. In some embodiments, the lighting panel group controller includes a building control system, such as, for example, an environmental control system, a communications system, a data network and/or an alarm system, among others. In some embodiments, the input signal may be generated responsive to data from an environmental sensor (block 1030). Some embodiments of an environmental sensor may include a smoke, fire, security, weather and/or other emergency condition sensor, among others.

Figure 11:
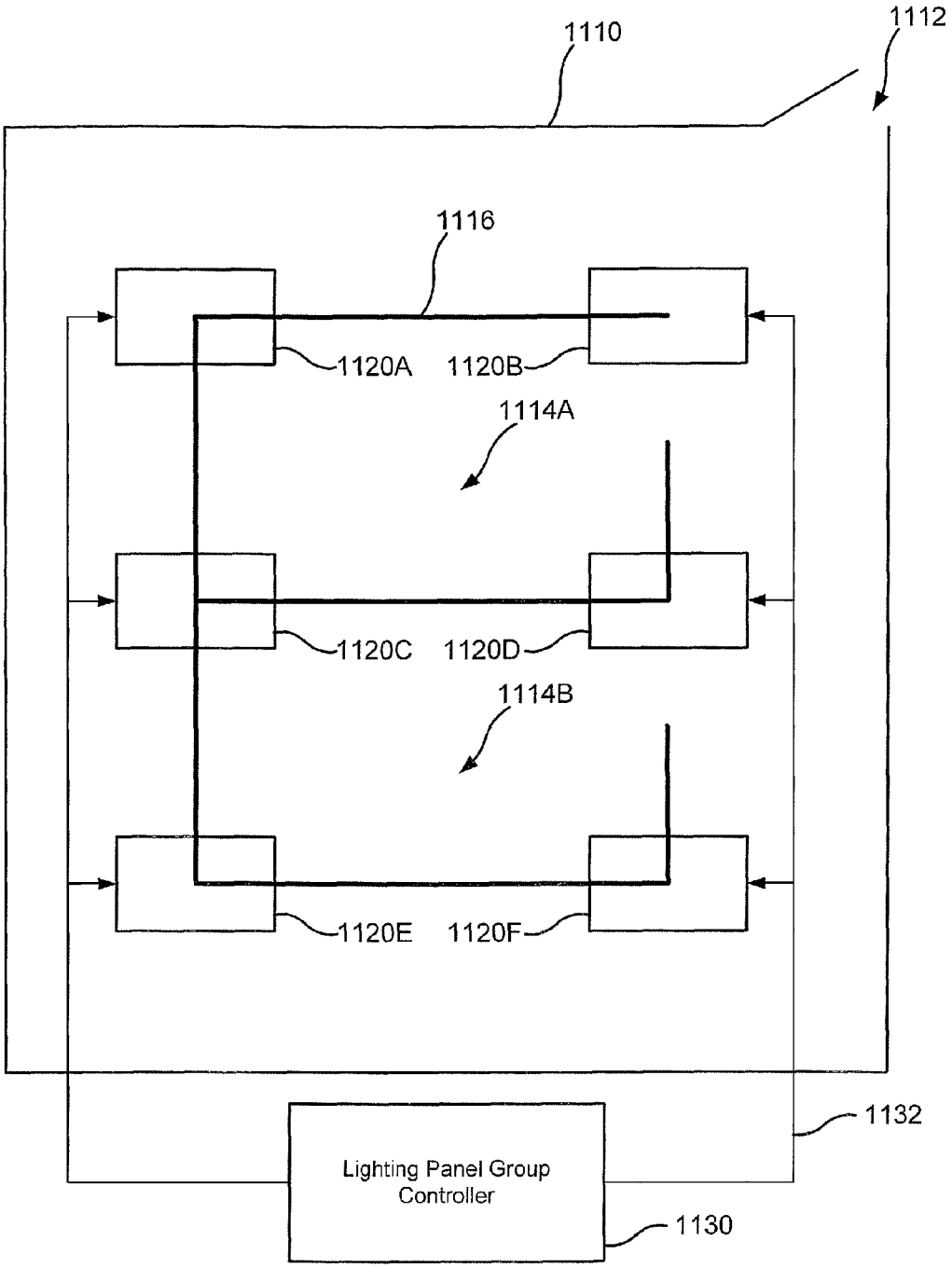
FIG. 11 is a block diagram illustrating a plan view of a system described herein in conjunction with an exemplary application thereof according to some embodiments of the present invention.

Reference is now made to FIG. 11, which is a block diagram illustrating a plan view of a system described herein in conjunction with an exemplary application thereof according to some embodiments of the present invention. A system for providing illumination and communication may include multiple solid-state lighting panels 1120A-F that are arranged in a personnel space in a spaced apart manner and that are collaboratively operated responsive to input signals 1132 that are transmitted by a lighting panel group controller 1130. In some embodiments, the solid-state lighting panels 1120A-F may be collaboratively operated to provide illumination in a first mode and to communicate information in a second mode.

The solid-state lighting panels 1120A-F may be configured to illuminate a personnel space 1110, such as, for example, an office, laboratory, manufacturing area, retail and/or other type of space designed to be occupied by personnel. The personnel space 1110 may include space dividers 1116, such as, for example, partitions and/or walls that are configured to define specific sub-spaces 1114A, B, such as, for example, cubicle spaces, among others. The personnel space 1110 may include an exit 1112 that provides egress.

In the first mode, all of the solid-state lighting panels 1120A-F may be operated to provide a relatively uniform illumination level throughout the personnel space 1110. In the second mode, selective ones of the solid-state lighting panels 1120A-F may be operated to communicate information to occupants of the personnel space 1110. For example, solid-state lighting panels 1120B, D and F may be operated in the second mode to communicate to occupants the location of the aisle that leads to the exit 1112. In this manner, during, for example, an emergency condition, occupants may be drawn to the aisles by virtue of the operation of the proximate solid-state lighting panels 1120B, D and F while solid-state lighting panels 1120A, C and E are not operated.

In some embodiments, solid-state lighting panels 1120B, D and F may be dynamically operated to provide a flashing sequence that is directed towards the exit 112. Some embodiments provide that solid-state lighting panel 1120B may be operated continuously while solid-state lighting panels 1120D and F may be dynamically operated to indicate the direction of the travel necessary to access the exit 1112. In some embodiments, selective ones of the solid-state lighting panels 1120A-F may be operated to provide substantially non-white light in the second mode. For example, solid-state lighting panels 1120A, C and E may be operated to emit light that includes a dominant wavelength corresponding to a red color. In some embodiments, the color of light emitted may be specific to the nature of the condition that is being communicated via the collaborative operation of the solid-state lighting panels 1120A-F. For example, light that includes a dominant wavelength corresponding to a blue color may be emitted to indicate a security related condition and/or event. Similarly, light that includes a dominant wavelength corresponding to a red color may be emitted to indicate a fire related condition and/or event.

The lighting panel group controller 1130 may include a building control system. In some embodiments, the lighting panel group controller 1130 may be configured to generate the input signal and/or change a state of the input signal responsive to an environmental condition sensor (not shown). In some embodiments, the lighting panel group controller 1130 may be configured to dynamically communicate information in the second mode by transmitting a sequence of input signals to the solid-state lighting panels 1120A-F.

In some embodiments, the light emitters within a solid-state lighting panel 1120A-F may be individually addressable, group addressable and/or may not be individually addressable. For example, a solid-state lighting panel 1120A-F may be limited to light emitters that are collectively operated responsive to a single signal and/or input.

In the drawings and specification, there have been disclosed typical embodiments of the invention and, although specific terms are employed, they are used in a generic and descriptive sense only and not for purposes of limitation, the scope of the invention being set forth in the following claims.

That which is claimed is:

1. A system for providing illumination and communication comprising:

a plurality of solid-state lighting panels that are arranged in an indoor space that includes a plurality of indoor sub-spaces that are each configured to have at least one of the plurality of solid-state lighting panels therein; and a lighting panel group controller that is configured to transmit the input signals to at least one of the plurality of solid-state lighting panels, wherein the plurality of solid-state lighting panels are operable to illuminate the plurality of sub-spaces in a first mode and are collaboratively controlled by the lighting panel group controller to communicate information to occupants in the second mode by selectively illuminating ones of the plurality of solid-state lighting panels, and wherein the input signals are transmitted responsive to the lighting panel group controller receiving an environmental information signal from an environmental condition sensor, and wherein the plurality of solid-state lighting panels comprise a first portion of solid-state lighting panels that are configured to provide illumination in the first mode and the second mode and a second portion of solid-state lighting panels that are configured to provide illumination in the first mode and not in the second mode, wherein the collaborative operation of the first portion and the second portion in the second mode communicate information.

2. The system according to claim 1, wherein the ones of the plurality of solid-state lighting panels are each configured to communicate a portion of the information to the occupants, and wherein the ones of the plurality of solid-state lighting panels are operated collaboratively to communicate the information to the occupants.

3. The system according to claim 1, wherein ones of the plurality of solid-state lighting panels are separate fixtures from one another.

4. The system according to claim 1, wherein the illumination provided in the first mode is substantially white light.

5. The system according to claim 1, wherein the plurality of solid-state lighting panels are spaced apart from one another in the indoor space when viewed in a plan view.

6. The system according to claim 1, wherein the ones of the plurality of solid-state lighting panels receive the environmental information signal from the environmental condition sensor.

7. The system of claim 1, wherein at least one of the plurality of solid-state lighting panels comprises a first portion of the solid-state light emitters that are configured to emit substantially white light and a second portion of the solid-state light emitters that are configured to emit substantially non-white light, and wherein the first portion of the solid-state light emitters are configured to emit light responsive to the first mode and the second portion of the solid-state light emitters are configured to emit light during the second mode.

8. The system of claim 1, wherein the lighting panel group controller comprises a building control system.

9. An apparatus, comprising:

a solid-state lighting panel that is arranged above a portion of an indoor personnel space and that is configured to illuminate the portion of the indoor personnel space, the solid-state lighting panel comprising a plurality of solid-state light emitters and an input module that is configured to receive an input signal that is generated by an environmental sensor, wherein the solid-state lighting panel is configured to illuminate the portion of the indoor personnel space when operating in a first mode by emitting substantially white light and is configured to communicate information to an occupant in the portion of the indoor personnel space when operating in a second mode responsive to receiving the input signal that is generated by the environmental sensor, wherein the indoor personnel space includes a plurality of indoor sub-spaces that are distinct from one another and that are separated from one another by walls or partitions, wherein the portion of the indoor space comprises one of the plurality of indoor sub-spaces, and wherein the information that is communicated to the occupant of the portion of the indoor space is a portion of a message that is communicated via collaborative operation of the solid-state lighting panel and other solid-state lighting panels that are in other ones of the plurality of indoor sub-spaces.

10. The apparatus according to claim 9, wherein the information that is communicated to the occupant of the portion of the indoor space is dependent on which of the plurality of indoor sub-spaces the corresponding one of the plurality of solid-state lighting panels is located in.

11. The apparatus according to claim 9, wherein the environmental sensor is remote from the solid-state lighting panel.

* * * * *